US010151061B1

(12) United States Patent
Farrel et al.

(10) Patent No.: US 10,151,061 B1
(45) Date of Patent: Dec. 11, 2018

(54) DRYER APPLIANCES AND METHODS OF OPERATION

(71) Applicant: Haier US Appliance Solutions, Inc., Wilmington, DE (US)

(72) Inventors: Caleb Farrel, Jeffersonville, IN (US); Silvia Prajescu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 15/663,938

(22) Filed: Jul. 31, 2017

(51) Int. Cl.

| | |
|---|---|
| ***D06F 58/28*** | (2006.01) |
| ***D06F 58/02*** | (2006.01) |
| *D06F 58/22* | (2006.01) |
| *D06F 58/26* | (2006.01) |

(52) U.S. Cl.
CPC ..... *D06F 58/28* (2013.01); *D06F 58/02* (2013.01); *D06F 58/22* (2013.01); *D06F 58/26* (2013.01); *D06F 2058/2854* (2013.01); *D06F 2058/2893* (2013.01)

(58) Field of Classification Search
CPC ..... D06F 58/28; D06F 58/02; D06F 58/22; D06F 58/26; D06F 2058/2854; D06F 2058/2893
USPC ..... 34/495, 595–610; 68/5 C, 5 R, 19, 20
See application file for complete search history.

(56) References Cited

U.S. PATENT DOCUMENTS

| | | | | |
|---|---|---|---|---|
| 5,187,879 | A * | 2/1993 | Holst | D06F 58/266 219/741 |
| 5,315,765 | A * | 5/1994 | Holst | D06F 58/20 219/707 |
| 7,146,749 | B2 * | 12/2006 | Barron | D06F 35/00 34/596 |
| 7,681,328 | B2 * | 3/2010 | DuVal | C11D 3/50 34/597 |
| 8,245,415 | B2 * | 8/2012 | Bellinger | D06F 58/28 34/389 |
| 8,256,139 | B2 * | 9/2012 | Morrison | D06F 58/28 34/413 |
| 8,549,770 | B2 * | 10/2013 | Bellinger | D06F 58/28 34/486 |
| 8,627,581 | B2 * | 1/2014 | Brown | D06F 58/02 34/603 |
| 8,819,958 | B2 | 9/2014 | Bellinger et al. | |
| 9,534,329 | B2 * | 1/2017 | Contarini | D06F 39/02 |
| 9,580,860 | B2 * | 2/2017 | Bellinger | D06F 58/28 |
| 9,617,680 | B2 * | 4/2017 | Kitayama | D06F 58/24 |
| 9,927,127 | B2 * | 3/2018 | Johnson | F24C 7/08 |
| 2009/0313848 | A1 * | 12/2009 | Moschutz | D06F 58/28 34/549 |
| 2015/0059200 | A1 | 3/2015 | Prajescu et al. | |
| 2018/0016734 | A1 * | 1/2018 | Green | D06F 58/28 |
| 2018/0027940 | A1 * | 2/2018 | Goldman | F26B 21/10 |

(Continued)

FOREIGN PATENT DOCUMENTS

| | | | | |
|---|---|---|---|---|
| EP | 3023531 | A1 * | 5/2016 | D06F 58/24 |
| EP | 2927365 | B1 | 10/2016 | |

*Primary Examiner* — Stephen M Gravini
(74) *Attorney, Agent, or Firm* — Dority & Manning, P.A.

(57) ABSTRACT

A dryer appliance, including methods of operation, is generally provided herein. At least one method may include measuring an ambient temperature of air unheated by the heater; comparing the measured ambient to a baseline ambient temperature; setting an airflow temperature threshold based on the comparison; and directing the heater based on the airflow temperature threshold.

14 Claims, 5 Drawing Sheets

(56) References Cited

U.S. PATENT DOCUMENTS

| | | | | |
|---|---|---|---|---|
| 2018/0031318 | A1* | 2/2018 | Goldman | F26B 23/04 |
| 2018/0106542 | A1* | 4/2018 | Goldman | F26B 23/04 |
| 2018/0135235 | A1* | 5/2018 | Yu | D06F 58/28 |

* cited by examiner

DRYER APPLIANCES AND METHODS OF OPERATION

FIELD OF THE INVENTION

The present subject matter relates generally to dryer appliances, and more particularly to dryer appliances including features and methods for varying heating operations.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Typical dryer appliances also generally include a heating assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, an air handler (such as a blower) is utilized to flow the internal air from the vent duct to the exhaust duct. When operating, a blower may pull air through itself from the vent duct, and this air may then flow from the blower to the exhaust conduit.

In order to provide enhanced control of a clothes dryer appliance, it can be desirable to know one or more conditions of air being flowed from the chamber. For example, heated air through the dryer appliance is preferably maintained below a certain threshold temperature, e.g., to avoid damaging articles that are drying within the chamber of the drum and prevent other overheating problems. Certain dryer appliances are equipped with temperature sensors for monitoring the temperature of heated air therein. If the temperature sensor detects overly hot air exiting the drum's chamber, the heating assembly can be deactivated or cycled.

Dryer appliances generally have a single preset threshold temperature for regulating air temperature from the drum's chamber. However, the conditions in which the dryer appliance operates may affect performance. For example, if the ambient conditions are hotter than those at which the threshold temperature is set, the heating assembly may be excessively cycled. In turn, drying times may be increased, inconveniencing users and wasting energy. Moreover, the clothes within dryer appliance may not reach a desired dryness level.

Accordingly, improved dryer appliances and methods for operating dryer appliances are desired in the art. In particular, dryer appliances and associated methods which facilitate time and energy-efficient performance across a variety of conditions would be advantageous.

BRIEF DESCRIPTION OF THE INVENTION

Aspects and advantages of the invention will be set forth in part in the following description, or may be obvious from the description, or may be learned through practice of the invention.

In one aspect of the present disclosure, a method for controlling a dryer appliance is provided. The method may include measuring an ambient temperature of air unheated by the heater; comparing the measured ambient to a baseline ambient temperature; setting an airflow temperature threshold based on the comparison; and directing the heater based on the airflow temperature threshold.

In another aspect of the present disclosure, a dryer appliance is provided. The dryer appliance may include a cabinet, a drum, an air passage, an air handler, a heater, a temperature sensor and a controller. The drum may be rotatably mounted within the cabinet. The drum may define a drying chamber. The air passage may be in fluid communication with the drying chamber. The air handler may be attached in fluid communication with the drying chamber to motivate an airflow therethrough. The heater may be attached to the drum in thermal communication with the drying chamber. The temperature sensor may be disposed in fluid communication with the air passage to detect temperature therein. The controller may be operatively connected to the air handler, the heater, and the airflow sensor. The controller configured to initiate a dryer cycle. The dryer cycle may include measuring an ambient temperature of air unheated by the heater, comparing the measured ambient temperature to a baseline ambient temperature, setting an airflow temperature threshold based on the comparison, and directing the heater based on the airflow temperature threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
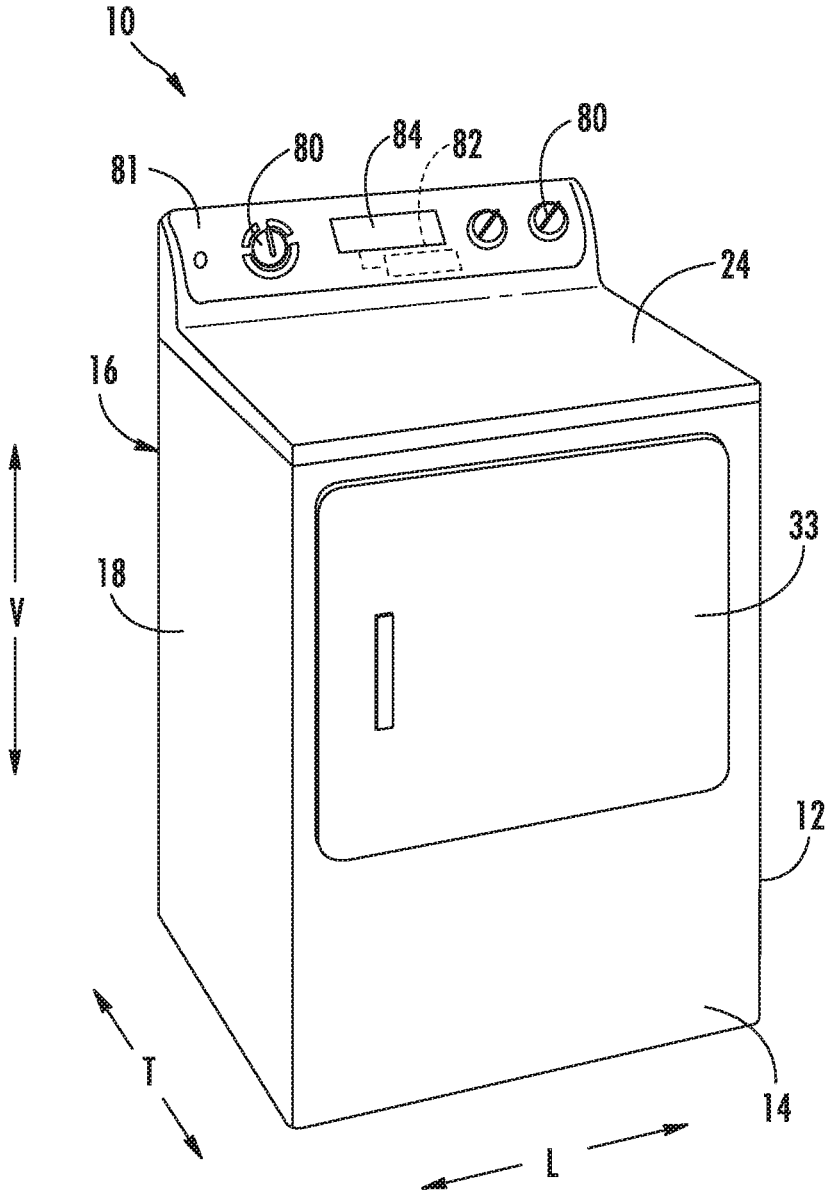
FIG. 1 provides a perspective view of a dryer appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
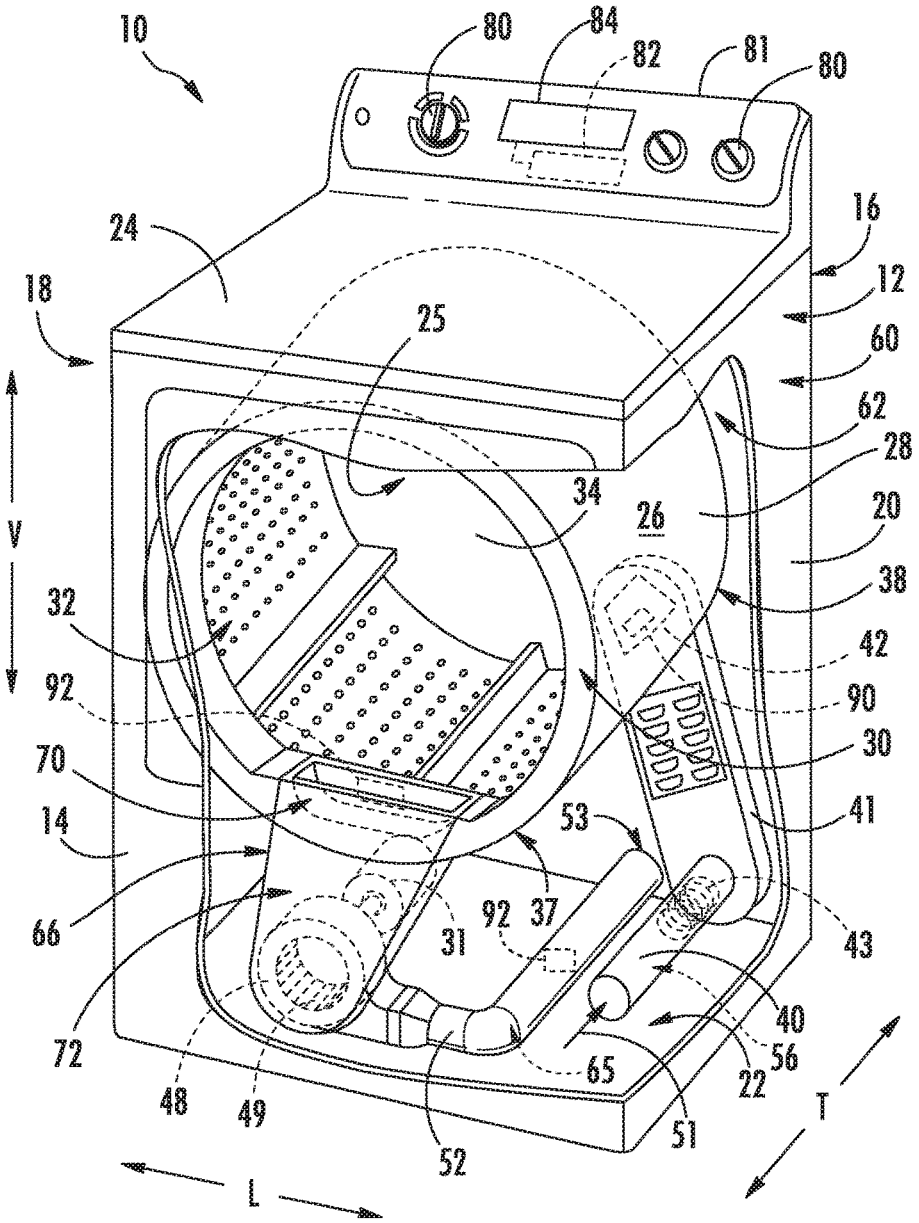
FIG. 2 provides a perspective view of the exemplary dryer appliance of FIG. 1 with portions of a cabinet of the exemplary dryer appliance removed to reveal certain components of the exemplary dryer appliance.
Figure 3:
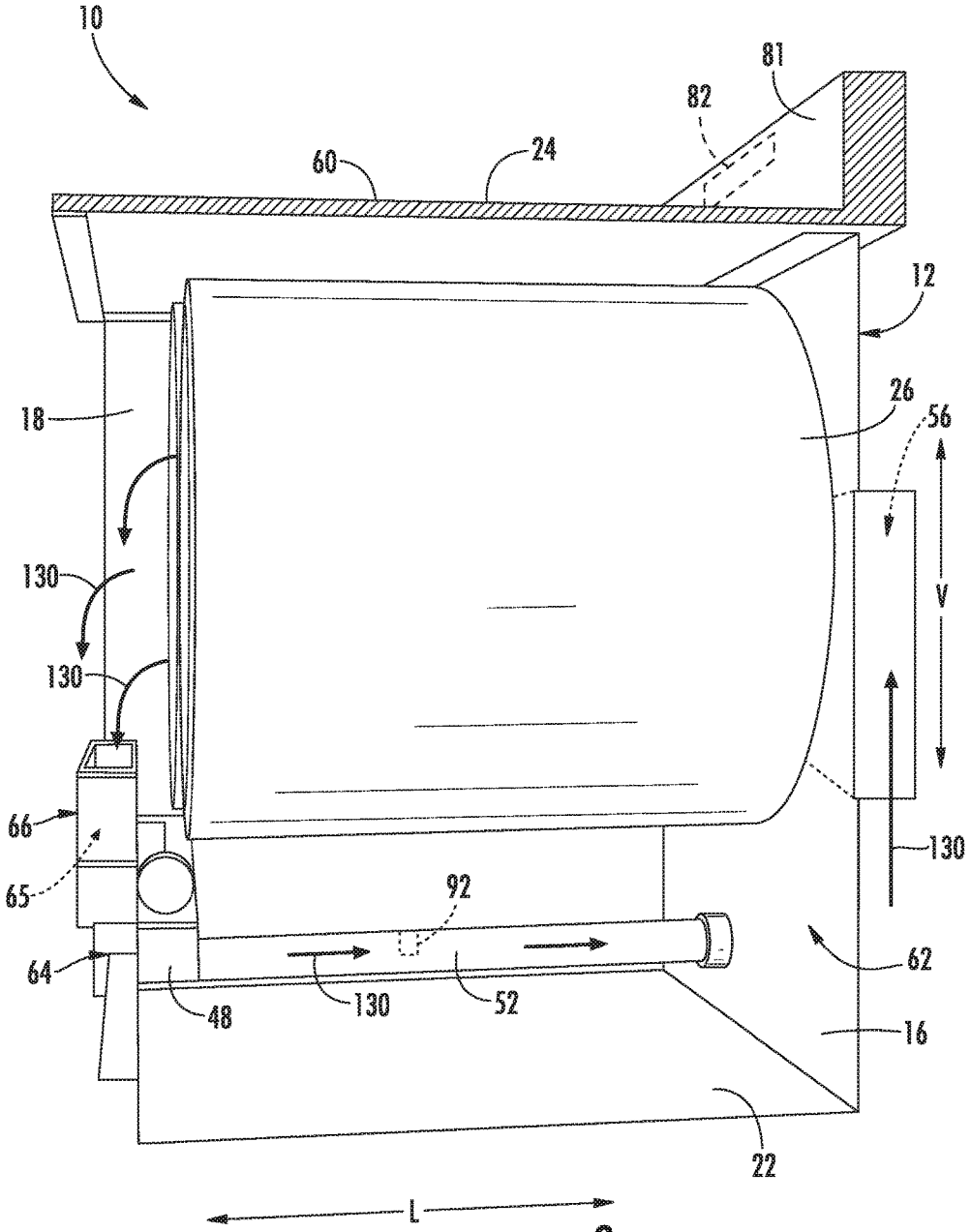
FIG. 3 provides a side schematic view of various components of a dryer appliance in accordance with the exemplary dryer appliance of FIG. 2.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. FIG. 3 provides a side schematic view of dryer appliance 10, and illustrates an airflow therethrough. While described in the context of a specific embodiment of a dryer appliance, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form an orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of cabinet 12 and an interior 62 of cabinet 12. Within interior 62 of cabinet 12 is a container or drum 26. Drum 26 defines a chamber 25 for receipt of articles, e.g., clothing, linen, etc., for drying. Drum 26 extends between a front portion 37 and a back portion 38, e.g., along the transverse direction T. In example embodiments, drum 26 is rotatable, e.g., about an axis that is parallel to the transverse direction T, within cabinet 12.

Drum 26 is generally cylindrical in shape, having an outer cylindrical wall or cylinder 28 and a front flange or wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. Rear wall 34 of drum 26 may be fixed relative to cabinet 12, e.g., such that cylinder 28 of drum 26 rotates on rear wall 34 of drum 26 during operation of dryer appliance 10.

An air handler 48, such as a blower or fan, may be provided to motivate an airflow 130 (FIG. 3) through air passages 56, 65. Specifically, air handler 48 may include a motor 31 may be in mechanical communication with a blower fan 49, such that motor 31 rotates blower fan 49. Air handler 48 is configured for drawing air through chamber 25 of drum 26, e.g., in order to dry articles located therein, as discussed in greater detail below. In alternative example embodiments, dryer appliance 10 may include an additional motor (not shown) for rotating fan 49 of air handler 48 independently of drum 26.

Drum 26 may be configured to receive heated air that has been heated by a heating assembly 40, e.g., in order to dry damp articles disposed within chamber 25 of drum 26. Heating assembly 40 includes a heater 43 that is in thermal communication with drying chamber 25. For instance, heater 43 may include one or more electrical resistance heating elements or gas burners, for heating air being flowed to chamber 25. As discussed above, during operation of dryer appliance 10, motor 31 rotates fan 49 of air handler 48 such that air handler 48 draws air through chamber 25 of drum 26. In particular, ambient air enters an air entrance passage defined by heating assembly 40 via an entrance 51 due to air handler 48 urging such ambient air into entrance 51. Such ambient air is heated within heating assembly 40 and exits heating assembly 40 as heated air. Air handler 48 draws such heated air through an air entrance passage 56, including inlet duct 41, to drum 26. The heated air enters drum 26 through an outlet 42 of duct 41 positioned at rear wall 34 of drum 26.

Within chamber 25, the heated air can remove moisture, e.g., from damp articles disposed within chamber 25. This internal air flows in turn from chamber 25 through an outlet assembly 64 positioned within interior 62. Outlet assembly 64 generally defines an air exhaust passage 65 and includes a vent duct 66, air handler 48, and an exhaust conduit 52. Exhaust conduit 52 is in fluid communication with vent duct 66 via air handler 48. During a dry cycle, internal air flows from chamber 25 through vent duct 66 to air handler 48, e.g., as an outlet flow portion of airflow 130. As shown, air further flows through air handler 48 and to exhaust conduit 52. The internal air is exhausted from dryer appliance 10 via exhaust conduit 52.

In exemplary embodiments, vent duct 66 can include a filter portion 70 and an exhaust portion 72. Exhaust portion 72 may be positioned downstream of filter portion 70 (in the direction of airflow 130 of the internal air). A screen filter of filter portion 70 (which may be removable) traps lint and other particulates as the internal air flows therethrough. The internal air may then flow through exhaust portion 72 and air handler 48 to exhaust conduit 52. After the clothing articles have been dried (or a drying cycle is otherwise completed), the clothing articles are removed from drum 26 via entry 32. A door 33 provides for closing or accessing drum 26 through entry 32.

One or more selector inputs 80, such as knobs, buttons, touchscreen interfaces, etc., may be provided on a cabinet backsplash 81 and in communication with a processing device or controller 82. Signals generated in controller 82 operate motor 31 and heating assembly 40, including heater 43, in response to the position of selector inputs 80. Additionally, a display 84, such as an indicator light or a screen, may be provided on cabinet backsplash 82. Display 84 may be in communication with controller 82, and may display information in response to signals from controller 82. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles (e.g., a temperature-contingent dryer cycle). For example, the instructions may include a software package configured to execute the example methods 400 and 500 described below with reference to FIGS. 4 and 5, respectively.

In some embodiments, dryer appliance 10 also includes one or more sensors. For example, dryer appliance 10 may include an airflow sensor 90. Airflow sensor 90 is generally operable to detect the velocity of air (e.g., as an air flow rate in meters per second, or as a volumetric velocity in cubic meters per second) as it flows through the appliance 10. Generally, airflow sensor 90 is at least partially positioned within air passage 56 or 65 to detect airflow 130. In some embodiments, airflow sensor 90 is positioned within inlet duct 41, e.g., at or proximal to an inlet of drum 26. Additionally or alternatively, airflow sensor 90 may be positioned at another suitable location, such as within exhaust conduit 52, vent duct 66, and/or another portion of inlet duct 41. Airflow sensor 90 may be embodied by any suitable configuration, such as a Pitot tube or a set of dual static-pressure taps connected to a pressure transducer. When assembled, airflow sensor 90 may be in communication with (e.g., electrically coupled to) controller 82, and may transmit readings to controller 82 as required or desired.

Dryer appliance 10 may further include, for example, one or more temperature sensors 92. Temperature sensor 92 is generally operable to measure internal temperatures in dryer appliance 10. In some embodiments, temperature sensor 92 is disposed proximal to an outlet of drum 26 (e.g., within vent duct 66). In additional or alternative embodiments, a temperature sensor 92 is disposed along exhaust conduit 52, in thermal communication therewith. For example, temperature sensor 92 may extend at least partially within passage 65 to measure the temperature of air therethrough. In further additional or alternative embodiments, a temperature sensor 92 may be disposed at any other suitable location within dryer appliance 10 to detect the temperature of airflow 130 (e.g., downstream from chamber 25). Temperature sensor 92 may be embodied as a thermistor, thermocouple, or any other suitable sensor for detecting a specific temperature value of air within appliance 10. When assembled, temperature sensor 92 may be in communication with (e.g., electrically coupled to) controller 82, and may transmit readings to controller 82 as required or desired.

In some embodiments, controller 82 is configured to vary operation of heating assembly 40 based on one or more temperatures detected at temperature sensor 92. For instance, controller 82 may automatically set or adjust one or more criteria for activation heating assembly 40 without an estimation of ambient conditions by a user. Specifically, controller 82 may determine an ambient temperature and set or adjust a threshold criterion accordingly. During use, controller 82 can initiate a temperature-contingent dryer cycle wherein a determination about the ambient conditions (e.g., ambient air temperature) is made, and operation of the appliance 10 is modified accordingly.

As an example, controller 82 may be generally configured to direct operations of heating assembly 40, including heater 43, based on one or more threshold temperatures. For instance, a user may select a specific dryer cycle (e.g., via selector inputs 80). In some such embodiments, once controller 82 receives an input signal from one or more of the selector inputs 80, controller 82 may initiate a preliminary sequence. As part of the preliminary sequence, controller 82 may establish (e.g., recall) one or more initial cycle thresholds for air being exhausted through chamber 25 during the selected dryer cycle. The initial cycle threshold(s) may be one or more predetermined values, for example, programmed into controller 82 during assembly. Each initial cycle threshold may have one or more associated baseline ambient temperature (e.g., a baseline range that includes an upper limit value and a lower limit value). Generally, the associated baseline(s) of an initial cycle threshold may correspond to ambient conditions (e.g., a range of temperatures) at which the initial cycle threshold was determined to be effective. Additionally or alternatively, a single associated temperature value may be set according to a specific testing temperature (i.e., a temperature at which the initial cycle threshold was determined).

In certain embodiments, once an initial cycle threshold is established, controller 82 may measure an ambient temperature. For instance, controller 82 may receive an ambient temperature signal from a temperature sensor 92 within exhaust air passage 65. If controller 82 is configured to receive a temperature signal from temperature sensor 92, the ambient temperature signal may be received before the heater 43 has been activated. In turn, the air whose temperature is being measured will be unheated by heating assembly 40.

Controller 82 may be further configured to set or adjust an airflow temperature threshold based on the measured ambient temperature. Specifically, controller 82 may compare the measured ambient temperature to one or more baselines. If the measured ambient temperature is determined to be within a preset range (e.g., greater than a lower baseline and/or less than an upper baseline). The threshold may be set as a predetermined initial cycle threshold value. By contrast, if the measured ambient temperature is determined to be outside of the preset range (e.g., less than or equal to the lower limit value, or greater than or equal to the upper limit value), the predetermined initial cycle threshold may be adjusted or modified to a new value. For instance, if the measured ambient temperature is greater than or equal to an upper baseline (e.g., upper limit value), an upper modifier may be added to the initial cycle threshold to provide a new value, which is set as a contemporary airflow temperature threshold. If the measured ambient temperature is less than or equal to a lower baseline (e.g., lower limit value), a lower modifier may be subtracted from the initial cycle threshold to provide a new value, which is set as a contemporary current airflow temperature threshold.

After the airflow temperature threshold is set, the controller 82 may activate heater 43 and/or air handler 48. Upon heater 43 being activated, controller 82 may direct operations thereof. In some such embodiments, controller 82 may receive one or more post-activation temperature signals from temperature sensor 92 (e.g., continuously or at a predetermined interval). Thus, controller 82 may measure heated air downstream from heater 43. Controller 82 may continue to compare heated air measurements to the set airflow temperature threshold. If the heated air measurement exceeds the set airflow temperature threshold, controller 82 may deactivate or cycle heater 43 (e.g., for a predetermined amount of time). Advantageously, controller 82 may ensure efficient and effective drying of articles within chamber 25. Moreover, a total cycle time may be advantageously reduced if completion of a dryer cycle is based on a detected humidity level for articles within chamber 25.

Figure 4:
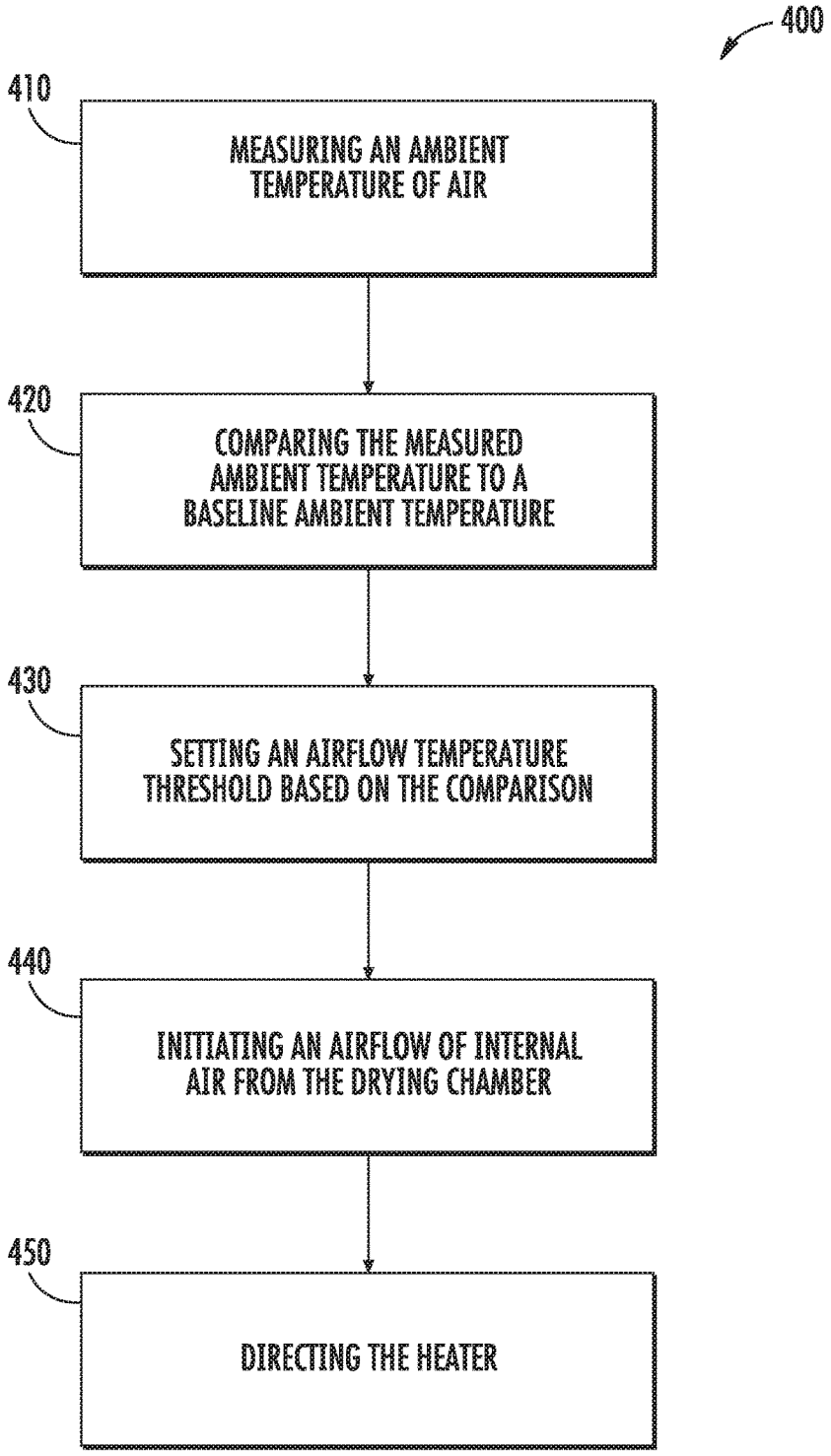
FIG. 4 provides a flow chart illustrating a method of operating a dryer appliance according to example embodiments of the present disclosure.
Figure 5:
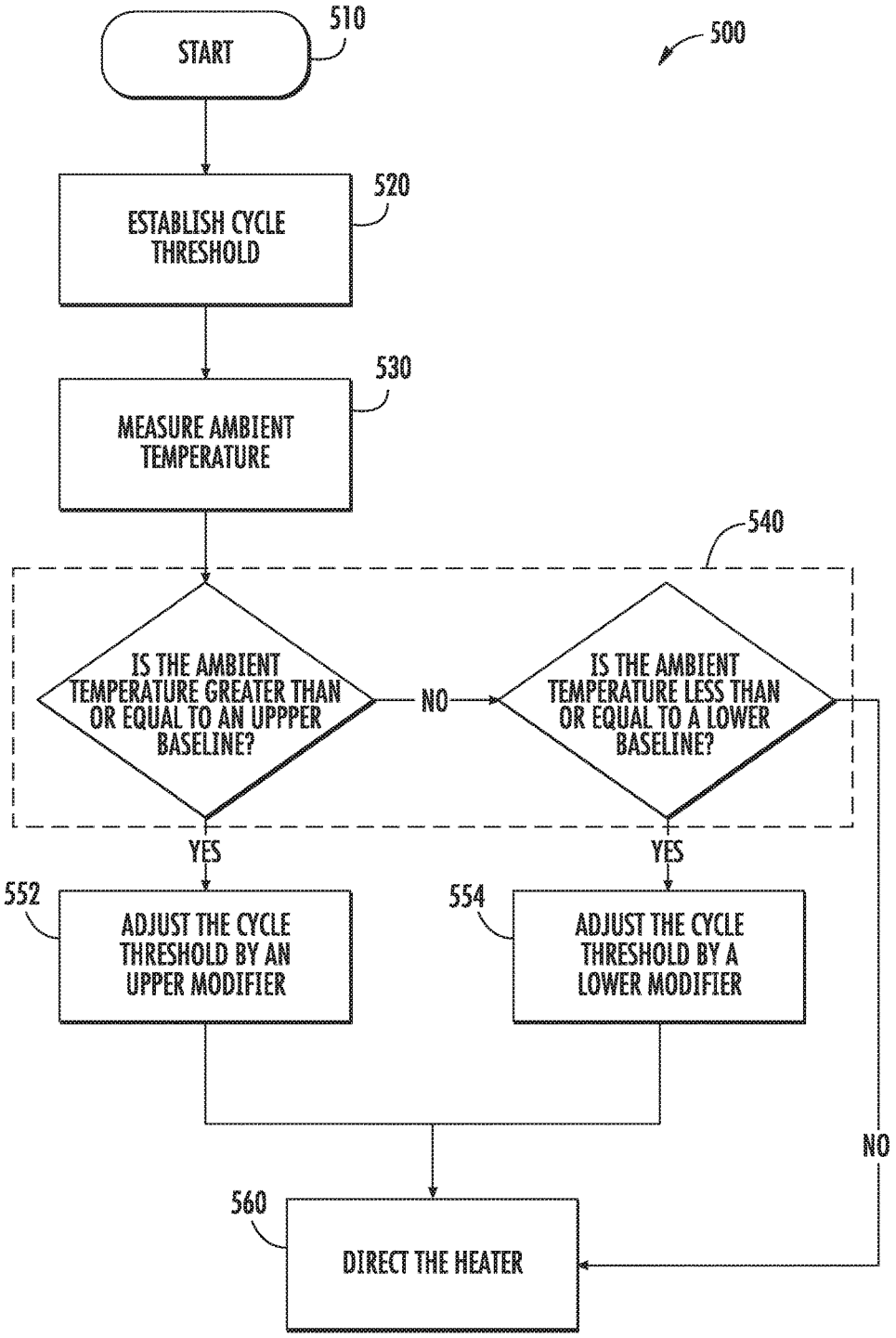
FIG. 5 provides a flow chart illustrating another method of operating a dryer appliance according to example embodiments of the present disclosure.

Turning now to FIGS. 4 and 5, flow diagrams are provided of methods 400 and 500, according to example embodiments of the present disclosure. Generally, the methods 400 and 500 provide methods for controlling a dryer appliance 10 that includes a drying chamber 25, one or more air passages 56, 65, and a heater 43, as described above. Each of the method 400 and the method 500 can be performed, for instance, by the controller 82. For example, controller 82 may, as discussed, be in communication with a temperature sensor 92, heater 43, and/or air handler 48. Moreover, controller 82 may send signals to and receive signals from sensor 92, heater 43, and/or air handler 48. Controller 82 may further be in communication with other suitable components of the appliance 10 to facilitate operation of the appliance 10, generally. FIGS. 4 and 5 depict steps performed in a particular order for purpose of illustration and discussion. Those of ordinary skill in the art, using the disclosures provided herein, will understand that (except as otherwise indicated) the steps of any of the methods disclosed herein can be modified, adapted, rearranged, omitted, or expanded in various ways without deviating from the scope of the present disclosure.

Referring to FIG. 4, at 410, the method 400 includes measuring an ambient temperature of air. The measurement at 410 may be based on a temperature signal from a temperature sensor mounted on or adjacent to a portion of the cabinet of the appliance. Additionally or alternatively, the measurement at 410 may be based on a temperature signal from a temperature sensor mounted within the cabinet of the appliance. For instance, the temperature signal may be received from the temperature sensor along the exhaust air passage, as described above. Thus, 410 may include receiving a temperature signal from within the exhaust air passage. In some such embodiments, 410 occurs while the heater remains inactive. Thus, the air being measured at 410 is not influenced or heated by the heater.

At 420, the method 400 includes comparing the measured ambient temperature at 410 to a baseline ambient temperature. The baseline ambient temperature may include an upper baseline, a lower baseline, or both. In turn, at 420 the method may include determining whether the measurement ambient temperature is greater than and/or equal to the upper baseline. Additionally or alternatively, at 420 the method may include determining whether the measured ambient temperature is greater and/or equal to the lower baseline.

At 430, the method 400 includes setting an airflow temperature threshold based on the comparison at 420. In response to certain comparison results, 430 may include adjusting a predetermined threshold value (e.g., initial cycle threshold value) for the airflow downstream from the heater. In response to other comparison results, 430 may include maintaining the predetermined threshold value. In certain embodiments, 430 includes increasing the predetermined threshold in response to the measured ambient temperature being above the upper limit value. In further embodiments, 430 includes decreasing the predetermined threshold in response to the measured ambient temperature being below a lower limit value.

In some embodiments, the adjustment of 430 includes altering the predetermined threshold value by a predetermined modifier value. As an example, the predetermined threshold value may be increased by adding a predetermined upper modifier to the predetermined threshold value (e.g., in response to the measured ambient temperature being above the upper limit value). As an additional or alternative example, the predetermined threshold value may be decreased by subtracting a predetermined lower modifier to the predetermined threshold value (e.g., in response to the measured ambient temperature being below the lower limit value).

In alternative embodiments, the adjustment of 430 includes altering the predetermined threshold value by a calculated modifier. In such embodiments, the method 400 further includes calculating the modifier value. Optionally, the calculated modifier value may be based on the measured ambient temperature. As an example, the calculated modifier value may be determined according to a variable function. For instance, a function for calculated the modifier value may be provided as:

$$m=M_{max}*[(T_a-T_i)/(T_u-T_i)]$$

wherein m is the modifier value to be calculated;

$M_{max}$ is a predetermined maximum modifier;

$T_a$ is the measured ambient temperature;

$T_i$ is a predetermined temperature value associated with the initial cycle threshold value; and $T_u$ is an upper limit value.

In optional embodiments, $M_{max}$ is a predetermined temperature value between 5° Fahrenheit and 25° Fahrenheit (e.g., 15° Fahrenheit). In additional or alternative embodiments, $T_i$ is a predetermined testing temperature value between 65° Fahrenheit and 80° Fahrenheit (e.g., 75° Fahrenheit).

At 440, the method 400 includes initiating an airflow of internal air from the drying chamber through a vent duct of the dryer appliance. For instance, the air handler may be activated to urge air through the heating assembly and chamber before flowing through the exhaust air passage (e.g., to the vent duct and exhaust conduit), as described above.

At 450, the method 400 includes directing the heater based on the airflow temperature threshold. As an example, the temperature of the airflow through the vent duct may be measured. The measured value may be compared to the airflow temperature threshold set at 430. Based on the comparison, 450 may include restricting the overall heat output or rate of heat output of the heater. Thus, the activation of the heater may be limited according to whether the measured value exceeds the temperature threshold. In some embodiments, restricting heat output includes deactivating the heater in response to the measured temperature of airflow exceeding the airflow temperature threshold. The heater may be held in a deactivated state, e.g., for a predetermined period of time. If the measured temperature of airflow does not exceed the airflow temperature threshold, the heater may remain active, e.g., until completion of the corresponding dryer cycle.

Referring to FIG. 5, at 510, the method 500 includes initiating a dryer cycle. For instance, the dryer cycle may be initiated in response to an input signal received from an input selector, as described above.

At 520, the method 500 includes establishing a predetermined cycle threshold. In some such embodiments, multiple initial cycle thresholds are established. Specifically, multiple predetermined initial cycle thresholds may be established (e.g., recalled) upon initiation of the dryer cycle. The predetermined initial cycle thresholds may correspond to various load sizes or contents (e.g., the type of fabric or articles being treated within the chamber). In turn, each initial cycle threshold may correspond to a discrete load size or content. Additionally or alternatively, the predetermined initial cycle thresholds may correspond to specific time periods during the dryer cycle.

At 530, the method 500 includes measuring an ambient temperature, e.g., subsequently or in tandem with 520. The measurement at 530 may be based on a temperature signal from a temperature sensor mounted on or adjacent to a portion of the cabinet of the appliance. Additionally or alternatively, the measurement at 530 may be based on a temperature signal from a temperature sensor mounted within the cabinet of the appliance. For instance, the temperature signal may be received from the temperature sensor within the exhaust air passage, as described above. Thus, 530 may include receiving a temperature signal from within the exhaust air passage. In some such embodiments, 530 occurs while the heater remains inactive. Thus, the air being measured at 530 is not influenced or heated by the heater.

At 540, the method 500 includes comparing the measured ambient temperature at 530 to a pair of baseline ambient temperature. Specifically, 540 includes comparing the measured ambient temperature to an upper baseline (e.g., upper limit value). If the ambient temperature is determined to be greater than or equal to the upper baseline, the method 500 may proceed to 552. By contrast, if the ambient temperature is determined to less than the upper baseline, 540 includes comparing the measured ambient temperature to a lower baseline (e.g., lower limit value). If the ambient temperature is determined to be less than or equal to the lower baseline, the method 500 may proceed to 554. By contrast if the ambient temperature is further determined to be greater than the lower baseline, the method may proceed to 560.

At 552, the method 500 includes increasing the cycle threshold (or thresholds) by an upper modifier. Specifically, the upper modifier is added to the predetermined threshold value. The upper modifier may be a predetermined value (e.g., 15° F.). Alternatively, the upper modifier may be a variable value (e.g., calculated according to the measured temperature value). Once the cycle threshold is increased, the method 500 may proceed to 560.

At 554, the method 500 includes decreasing the cycle threshold (or thresholds) by a lower modifier. Specifically, the lower modifier is subtracted from the predetermined threshold value. The lower modifier may be a predetermined value (e.g., 15° F.). Alternatively, the lower modifier may be a variable value (e.g., calculated according to the measured temperature value). Once the cycle threshold is decreased, the method 500 may proceed to 560.

At 560, the method 500 includes directing the heater based on the cycle threshold. As an example, the temperature of the airflow through the vent duct may be measured. The measured value may be compared to the cycle threshold. Based on the comparison, 560 may include restricting heat output of the heater. Thus, the activation of the heater may be limited according to whether the measured value exceeds the temperature threshold. In some embodiments, restricting heat output includes deactivating the heater in response to the measured temperature of airflow exceeding the airflow temperature threshold. The heater may be held in a deactivated state, e.g., for a predetermined period of time. If the measured temperature of airflow does not exceed the airflow temperature threshold, the heater may remain active, e.g., until completion of the corresponding dryer cycle.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for controlling a dryer appliance, the dryer appliance including a drying chamber, an air passage in fluid communication with the drying chamber, and a heater in thermal communication with the drying chamber, the method comprising:

measuring an ambient temperature of air unheated by the heater;

comparing the measured ambient temperature to a baseline ambient temperature;

setting an airflow temperature threshold based on the comparison;

initiating an airflow of internal air from the drying chamber through an air exhaust passage of the dryer appliance;

measuring a temperature of the airflow through the air exhaust passage;

comparing the measured temperature of the airflow to the airflow temperature threshold;

activating the heater; and directing the heater based on the airflow temperature threshold, wherein directing the heater comprises restricting heat output of the heater in response to the comparison, wherein measuring the ambient temperature comprises receiving a temperature signal from a temperature sensor within the air exhaust passage before activating the heater, and wherein measuring the temperature of the airflow comprises receiving a temperature signal from the temperature sensor within the air exhaust passage after activating the heater.

2. The method of claim 1, wherein setting the airflow temperature threshold comprises adjusting a predetermined threshold value.

3. The method of claim 2, wherein adjusting comprises increasing the predetermined threshold value in response to the measured ambient temperature being above an upper limit value.

4. The method of claim 2, wherein adjusting comprises decreasing the predetermined threshold value in response to the measured ambient temperature being below a lower limit value.

5. The method of claim 2, wherein adjusting comprises altering the predetermined threshold value by a predetermined modifier value.

6. The method of claim 2, further comprising calculating a modifier value based on the measured ambient temperature, wherein adjusting comprises altering the predetermined threshold value by the calculated modifier value.

7. The method of claim 1, wherein restricting heat output comprises deactivating the heater in response to the measured temperature of airflow exceeding the airflow temperature threshold.

8. A dryer appliance comprising:

a cabinet;

a drum rotatably mounted within the cabinet, the drum defining a drying chamber;

an air passage in fluid communication with the drying chamber;

an air handler attached in fluid communication with the drying chamber to motivate an airflow therethrough;

a heater attached to the drum in thermal communication with the drying chamber;

a temperature sensor disposed in fluid communication with the air passage to detect temperature therein; and a controller operatively connected to the air handler, the heater, and the airflow sensor, the controller being configured to initiate a dryer cycle, the dryer cycle comprising measuring an ambient temperature of air unheated by the heater at the temperature sensor, comparing the measured ambient temperature to a baseline ambient temperature, setting an airflow temperature threshold based on the comparison, initiating an airflow of internal air from the drying chamber through an air exhaust passage of the dryer appliance, measuring a temperature of the airflow through the air exhaust passage, comparing the measured temperature of the airflow to the airflow temperature threshold, activating the heater, and directing the heater based on the airflow temperature threshold, wherein directing the heater comprises restricting heat output of the heater in response to the comparison, wherein measuring the ambient temperature comprises receiving a temperature signal from the temperature sensor before activating the heater, and wherein measuring the temperature of the airflow comprises receiving a temperature signal from the temperature sensor after activating the heater.

9. The dryer appliance of claim 8, wherein setting the airflow temperature threshold comprises adjusting a predetermined threshold value.

10. The dryer appliance of claim 9, wherein adjusting comprises increasing the predetermined threshold value in response to the measured ambient temperature being above an upper limit value.

11. The dryer appliance of claim 9, wherein adjusting comprises decreasing the predetermined threshold in response to the measured ambient temperature being below a lower limit value.

12. The dryer appliance of claim 9, wherein adjusting comprises altering the predetermined threshold value by a predetermined modifier value.

13. The dryer appliance of claim 9, wherein the dryer cycle further comprises calculating a modifier value based on the measured ambient temperature, wherein adjusting comprises altering the predetermined threshold value by the calculated modifier value.

14. The dryer appliance of claim 8, wherein restricting heat output comprises deactivating the heater in response to the measured temperature of airflow exceeding the airflow temperature threshold.

* * * * *